US009322241B2

(12) United States Patent
Saltel

(10) Patent No.: US 9,322,241 B2
(45) Date of Patent: Apr. 26, 2016

(54) METHOD AND DEVICE FOR SEALING A WELL BY MEANS OF A CORE PLUG, PLUG FOR IMPLEMENTING THE METHOD, AND EXTRACTOR TOOL DESIGNED TO REMOVE IT

(75) Inventor: Jean-Louis Saltel, Le Rheu (FR)

(73) Assignee: Saltel Industries (FR)

( * ) Notice: Subject to any disclaimer, the term of this patent is extended or adjusted under 35 U.S.C. 154(b) by 583 days.

(21) Appl. No.: 13/642,700

(22) PCT Filed: Apr. 11, 2011

(86) PCT No.: PCT/EP2011/055616

§ 371 (c)(1),
(2), (4) Date: Oct. 22, 2012

(87) PCT Pub. No.: WO2011/131504

PCT Pub. Date: Oct. 27, 2011

(65) Prior Publication Data

US 2013/0105158 A1 May 2, 2013

(30) Foreign Application Priority Data

Apr. 20, 2010 (FR) ..... 10 52989

(51) Int. Cl.
*E21B 33/13* (2006.01)
*E21B 33/12* (2006.01)
*E21B 33/134* (2006.01)

(52) U.S. Cl.
CPC ..... *E21B 33/13* (2013.01); *E21B 33/12* (2013.01); *E21B 33/1204* (2013.01); *E21B 33/1208* (2013.01); *E21B 33/134* (2013.01)

(58) Field of Classification Search
USPC ..... 166/290, 135, 285
See application file for complete search history.

(56) References Cited

U.S. PATENT DOCUMENTS 2,214,226 A 9/1940 English
2,656,891 A 10/1953 Toelke
3,687,202 A * 8/1972 Young et al. ..... 166/305.1

(Continued)

FOREIGN PATENT DOCUMENTS

CA 2518225 A1 3/2007
EP 1669540 A1 6/2006

OTHER PUBLICATIONS

International Search Report for Application No. PCT/EP2011/055616 dated Jul. 5, 2011.

(Continued)

*Primary Examiner* — Taras P Bemko
(74) *Attorney, Agent, or Firm* — Lerner, David, Littenberg, Krumholz & Mentlik, LLP

(57) ABSTRACT

Methods and apparatus for sealing a well are disclosed. The method includes introducing a plug axially into the well, with a mouth of the plug turned up and a bottom wall part turned down, the plug being positioned in the well at a desired depth. The plug is inflated by injecting a high-pressure liquid into it via its mouth so that a tubular wall part of the plug expands radially beyond its elastic limit and presses firmly and tightly against the wall of the well by a crimping effect, while its bottom wall part serves as a sealing partition, forming a tight barrier between lower and upper parts of the well that it separates. The plug has an internal axial mandrel that connects its mouth to its bottom wall, the mandrel being pierced with channels that allow injection of high-pressure liquid inside the plug via the mouth and channels.

18 Claims, 6 Drawing Sheets

(56) References Cited

U.S. PATENT DOCUMENTS

| | | | | |
|---|---|---|---|---|
| 2007/0151738 | A1* | 7/2007 | Giacomino | 166/372 |
| 2009/0183875 | A1* | 7/2009 | Rayssiguier et al. | 166/290 |
| 2009/0188569 | A1* | 7/2009 | Saltel | 137/15.11 |

OTHER PUBLICATIONS

French Search Report for Application No. FR1052989 dated Sep. 8, 2010.

* cited by examiner

METHOD AND DEVICE FOR SEALING A WELL BY MEANS OF A CORE PLUG, PLUG FOR IMPLEMENTING THE METHOD, AND EXTRACTOR TOOL DESIGNED TO REMOVE IT

CROSS REFERENCE TO RELATED APPLICATIONS

This application is a national phase entry under 35 U.S.C. §371 of International Application No. PCT/EP2011/055616, filed on Apr. 11, 2011, which claims priority from French Patent Application No. 1052989, filed on Apr. 20, 2010, the disclosures of which are hereby incorporated herein by reference.

The present invention concerns a method and a device for sealing a well by means of a core plug.

It also concerns a core plug usable for implementing the method, as well as an extractor tool designed to remove the plug.

The term "well" conventionally means, in the present description and the claims that follow, a well providing water or hydrocarbons (especially petroleum or natural gas) whether drilled with rough walls or lined with a casing, as well as a pipeline used to transport fluid.

In the following, the well is vertical and straight.

Conventionally, we speak of "depth" to designate the distance the separates the area to be sealed from the well entry.

However, it goes without saying that the well can be curved, sinuous, oblique or even horizontal.

The objective of the invention is to seal the well at a given depth zone, for example to abandon it (at the end of production) or to isolate the lower area from the rest of the well.

This seal must be liquid tight.

The usual technique to do this is to use a tool with an elastically deformable membrane, for example, inflatable, a tool commonly designated by the English word "packer" in the petroleum field.

One difficulty of this technique is that after positioning and radial expansion, the tool membrane must remain firmly and tightly pressed against the well wall. For example, if it is an inflatable bladder, a sufficient inflation pressure must be permanently maintained in the well to prevent the packer from returning to its initial shape.

In the long term, it can pose a problem of pressure leak and/or loss of elasticity (due to aging, heat and/or corrosion).

Furthermore, a packer is relatively expensive.

The principle on which the present invention is based consists of using a metal plug, of stainless steel, for example, this plug comprising a tubular wall part (generally annular sleeve), whose diameter is slightly smaller than that of the well, and a bottom wall part (transverse, or approximately transverse with regard to the sleeve axis) of one piece with this tubular wall.

The plug has an open end, called "mouth".

To seal a well, the plug is introduced into it axially, with its bottom wall turned down, and it is positioned in the well at the desired depth.

Then the plug is inflated by injecting a liquid at high pressure so that the tubular wall part of the plug is expanded radially beyond its elastic limit, coming to press firmly and tightly against the well wall by a crimping effect.

The bottom wall part then serves as a partition between the lower parts and the upper parts of the well.

Because the deformation of the tubular wall of the plug is permanent, the plug remains in place after removal of the high-pressure liquid and the risk of eventual loosening is practically eliminated.

This method is inexpensive and easy to implement.

The device of the invention comprises an apparatus that allows lowering, properly positioning and inflating the plug by means of a high-pressure liquid, and that can be removed after the plug has been positioned and expanded.

Note that forming a tubular metal sleeve beyond its elastic limit by use of a high-pressure liquid (hydroforming) is well known to line a portion of a well wall; however said sleeve is not connected to a bottom wall that can serve as a sealing partition.

In the state of the art, U.S. Pat. No. 2,214,226 should also be mentioned (see FIG. 4, in particular).

The sealing system that is described therein comprises a plug 11*a* of ductile metal that has a tubular wall that can be radially expanded beyond its elastic limit, against the well wall, as well as a bottom wall that can then seal the well.

However, according to this known method, the plug is deformed by means of an explosive charge 12 that is positioned inside the plug to be expanded, and not by introduction of a high-pressure liquid inside this plug. While a hydraulic pressure is effectively produced inside the plug, this results from exploding the charge, which generates a pressure in the liquid column (of mud in this case) present in the well, as is explained on page 3, left column, lines 27-38 of document U.S. Pat. No. 2,214,226.

The state of the art can also be illustrated by document U.S. Pat. No. 2,656,891.

The invention aims to improve the technique according to the prior art by better controlling the deformation of the plug.

In fact, according to the prior art, we are dealing with a bottom effect, explained below in the description, which limits the radial expansion capacity of the plug before breaking.

The invention therefore concerns, in a first aspect, a method for sealing a well by means of a plug of ductile metal, which comprises a tubular wall part whose diameter is slightly smaller than that of the well, and a bottom wall part connected to this tubular wall part, said plug having an open end forming a mouth turned up and its bottom wall part turned down, and it is positioned in the well at the desired depth, after which the plug is inflated by injecting a high-pressure liquid into it via its mouth so that its tubular wall part expands radially beyond its elastic limit and comes to press firmly and tightly against the wall of the well by a crimping effect, while its bottom wall part serves as a sealing partition, forming a tight barrier between the lower and upper parts of the well that it separates, and is characterized by the fact that a plug is used that is provided internally with an axial mandrel that connects its open end forming the mouth to its bottom wall, this mandrel being pierced with channels that allow the injection of high-pressure liquid inside the plug via the mouth and via these channels.

Furthermore, according to a certain number of additional non-limiting characteristics of this method:

- liquid and curable cement is used for the high-pressure liquid;
- the plug is introduced and positioned in the well by means of a hollow rod that is provided with an axial channel and is connected tightly to the mouth, this rod being maneuvered from the head of the well, and the high-pressure liquid is injected inside said plug from the head of the well via said channel, to inflate and expand it;

after expansion and crimping of the plug against the well wall, the hollow rod is disconnected from the crimped plug and it is removed by axially traction;

after expansion and crimping of the plug against the wall of the well, a liquid curable cement is poured, forming a second barrier, over the crimped plug;

this cement is poured into the well from the well head via the channel of said hollow rod;

after positioning and inflating the cap, the liquid is kept at high pressure inside the crimped cap.

In a second aspect, the invention concerns a metal core plug for sealing a well.

This core plug for sealing a well according to a method that consists of introducing this plug axially into the well, with its mouth turned up and its bottom wall part turned down, and positioning it in the well at the desired depth, after which the plug is inflated by injecting a high-pressure liquid via its mouth so that its tubular wall part expands radially beyond its elastic limit and comes to press firmly and tightly against the well wall by a crimping effect, while its bottom wall part serves as a sealing partition, forming a tight barrier between the lower parts and the upper parts of the well that it separates, this plug having the general shape of a bottle whose mouth corresponds to the bottleneck, characterized by the fact that it is provided internally with an axial mandrel that connects its open end forming the mouth to its bottom wall, this mandrel being pierced with channels that allow the injection of high-pressure liquid inside the plug via the mouth and via these channels.

According to some possible embodiments of the plug:

said axial mandrel is attached to the plug wall at its upper and lower ends so that it plays the role of a spacer that can impede the shortening of the plug along the axial direction during its radial expansion;

the axial mandrel is attached to the plug wall by its upper end only, while its lower end has a cylindrical bulge serving as the bottom wall for the plug, its lower portion sliding freely and tightly on said cylindrical bulge, or that said mandrel is attached to the plug wall by its lower end only, this end having a cylindrical bulge serving as the bottom wall for the plug, the upper part of the plug sliding freely and tightly along said mandrel, so as to be able to shorten naturally along the axial direction during its expansion in the radial direction;

its tubular wall part is provided externally with at least one annular gasket of flexible and elastic material, that can be crushed to press intimately against the well wall after crimping, and/or metal pins that can at least partially penetrate into the well wall;

its upper part forming a mouth has a base with a hooking profile that can allow extracting the crimped plug by means of a tool provided with suitable hooks;

this base with hooking profile is made up of the upper part of the mandrel;

its wall is stainless steel;

it has a rod for axial handling whose lower end part is provided with a set of articulated hooks that can automatically grip said base when the tool is lowered axially into the wells so that the crimped plug is then extracted from the well by axial traction upward;

said lower end part is provided with a small axial pushrod that can induce opening of the check valve when the tool is lowered axially into the well and that its lower end part comes to be supported against said base, so that the high-pressure liquid can escape the crimped plug;

it is provided with a piston and cylinder suction system designed to automatically generate a vacuum inside the crimped plug under the effect of the axial traction exerted upward on the shaft, in view of extracting this plug;

it consists of a metal core plug and its extraction tool.

In a third aspect, the invention concerns a tool for extracting a core plug, after the plug has been crimped into a well, the upper part forming the mouth of the plug having a base with a hooking profile as indicated above.

This tool has a rod for axial handling whose lower end part is provided with a set of articulated hooks that can automatically grip said base when the tool is lowered axially into the well so that the crimped plug is then extracted from the well by upward axial traction.

This tool can be designed to allow the extraction of a plug whose mouth is provided with a check valve that can impede the escape of high-pressure liquid from the plug after crimping.

In this case, the lower end part of its handling rod is provided with a small axial pushrod that can induce opening of the check valve when the tool is lowered axially into the well and its lower end part comes to be supported against said base, so that high-pressure liquid can escape the crimped plug.

Such a tool is advantageously provided with a piston and cylinder suction system designed to automatically generate a vacuum inside the crimped plug under the effect of the axial traction exerted upward on the shaft, in view of extracting this plug.

Finally, the invention relates to a set made up of a core plug and its extraction tool such as described above.

Other characteristics and advantages of the invention will appear upon reading the following description of one preferred embodiment of the invention. This description is made in reference to the attached drawings in which.

Note that in FIGS. 6, 7, 8 and 9, the left and right half views represent, respectively, the situation before and after the sealing plug is inflated.

Figure 2:
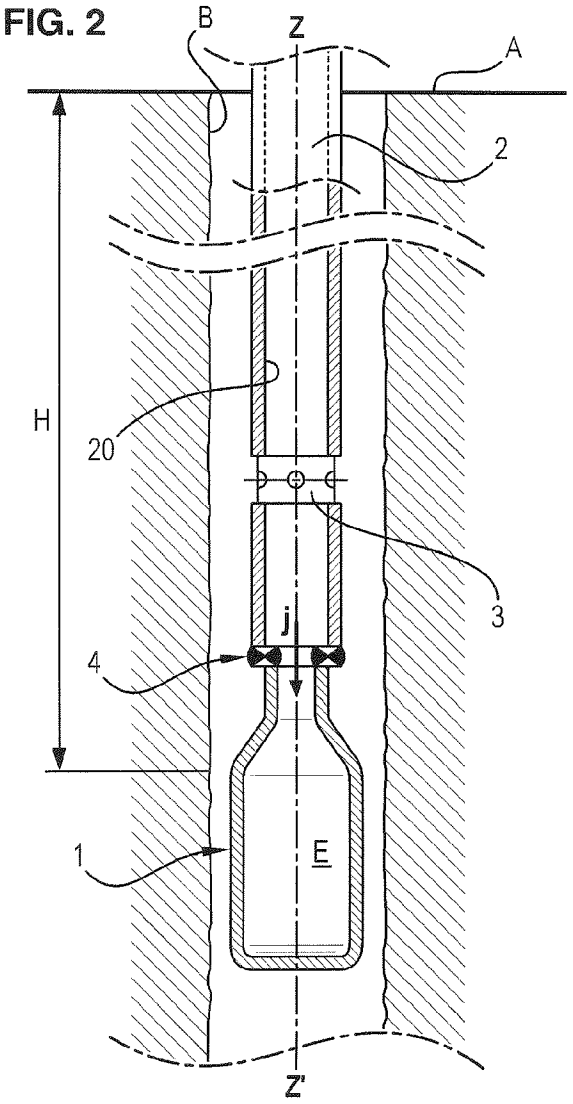
FIGS. 1 to 5 are axial schematic views illustrating the main implementation steps of the method according to the state of the art.
Figure 1:
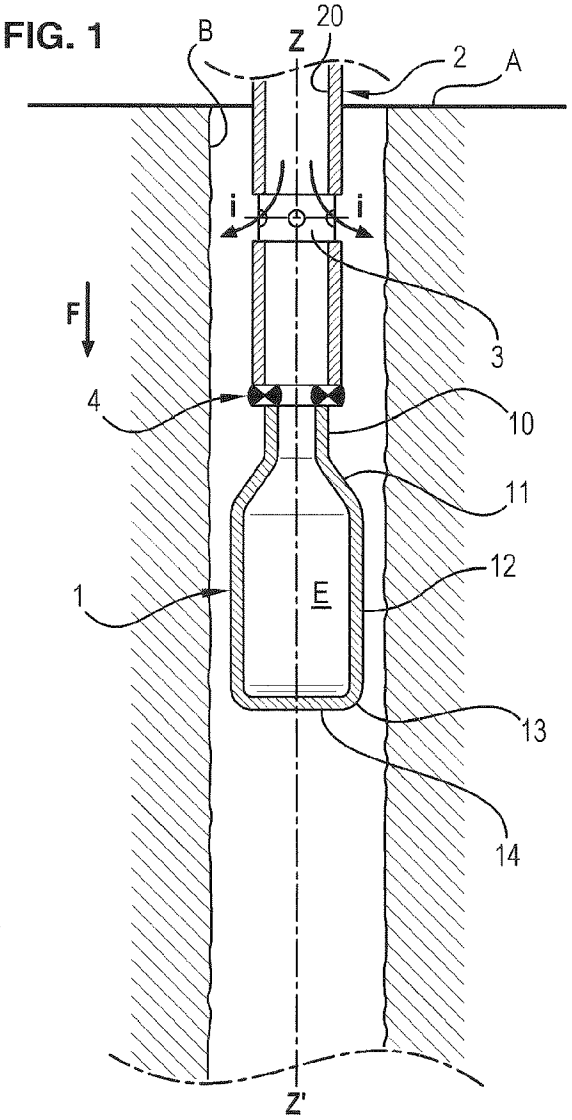

In reference to FIGS. 1 and 2, the sealing plug is designated 1; we wish to position it in a well with "rough" wall B, of vertical axis Z-Z', at a depth H with regard to ground level A (where the well head is found).

Plug 1 is roughly bottle-shaped, comprising a cylindrical bottleneck, or mouth, 10, a cylindrical body of greater diameter 12 and a flat bottom 14. Bottleneck 10 is connected to body 12 by a tapering part 11, while body 12 is connected to bottom 14 by a rounded area 13.

The outer diameter of body 12 is slightly less than the diameter of well wall B.

In the example illustrated, plug 1 is in one piece, of stainless steel, with a wall thickness substantially thinner than its diameter.

The device for positioning plug 1 comprises a hollow cylindrical rod 2, pierced with a coaxial central channel 20.

The diameter of this rod is notably smaller than that of the diameter of well wall B.

Tubular rod 2 is, for example of the "CT" (coil tubing) type, meaning a very long rod unwound from a roll, or the "DP" (drill pipe) type, meaning a long rod formed by a series of rod sections screwed end to end.

It serves two functions, i.e., holding the plug during its positioning, and serving as a conduit for the introduction of a high-pressure (HP) liquid into the plug to inflate it and crimp it inside the well.

Rod 2 also has a liquid circulation valve 3, which valve can be opened as needed to connect channel 20 and the inside of the well; this type of valve, which allows controlling the well during the descent, as well as the means for controlling the opening or closing, are well known in themselves.

In FIG. 1, valve 3 is open and arrows i symbolize the injection of sludge of appropriate density into the well via channel 20 during lowering F of rod 2.

The lower end of this rod 2 is connected tightly to bottleneck 10 by means of a breakable connection system 4.

System 4 can be designed to induce breakage of the connection by applying a traction force beyond a given threshold and/or by applying an overpressure.

This system does not prevent the communication (tight) of channel 20 with inner space E of plug 1.

In FIG. 2, rod 2 has been lowered to desired depth H, so that plug 1 is positioned with regard to the area to be sealed.

Valve 3 is shut.

Then a high-pressure liquid is introduced from well head A via channel 20 into space E, as shown by arrow j.

Figure 3:
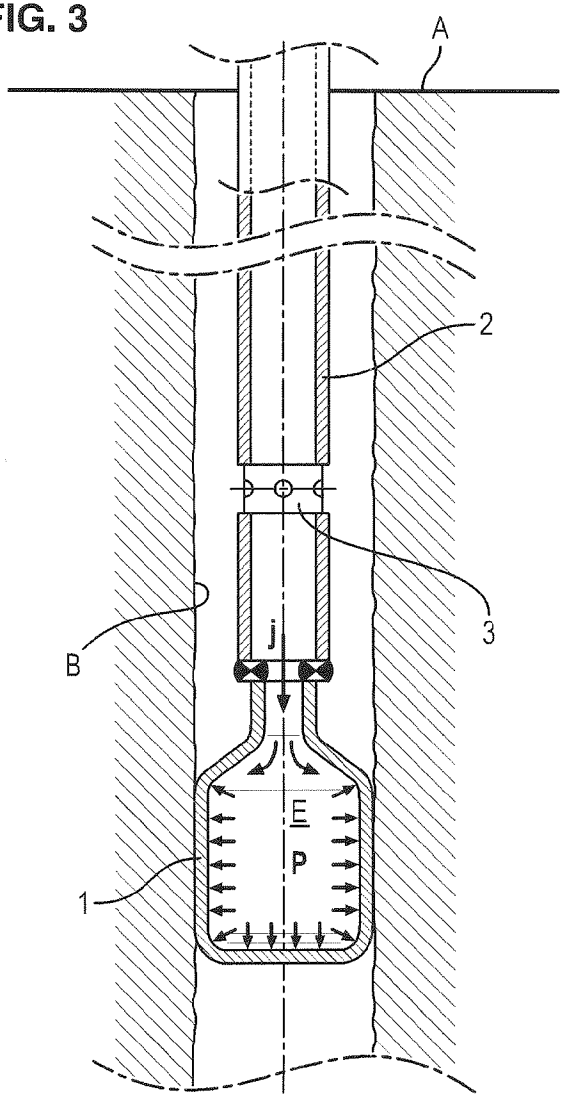

This pressure P is chosen to be sufficiently high to induce inflation of plug 1 and radial expansion of its main cylindrical part, whose wall comes to press firmly against well wall B (FIG. 3).

The material is deformed beyond its elastic limit.

Figure 4:
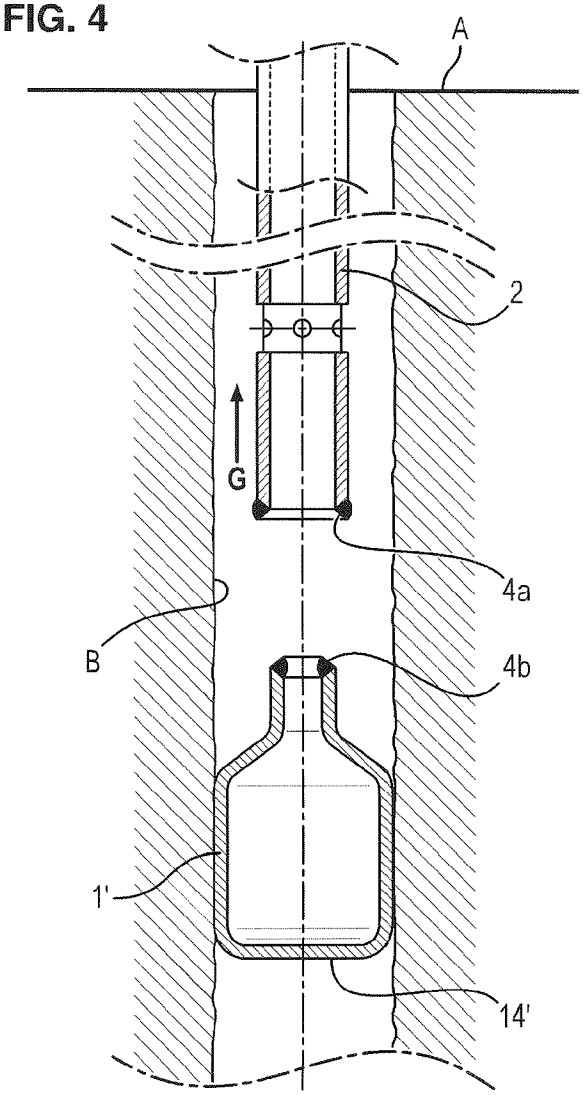

In reference to FIG. 4, the application of high-pressure liquid is stopped and rod 2 is pulled axially upwards (Arrow G).

Since core plug 1' is found crimped permanently inside the well, this pulling breaks connection system 4, of which one part 4*a* remains attached to the end of the rod and the other part 4*b* to the neck of the plug.

As indicated above, the connection can also be broken by a system sensitive to overpressure (known in itself).

Bottom 14' of plug 1' thus crimped then serves as sealing partition for the well, conforming to the objective sought, playing a barrier role between the parts of the well located above and below the plug.

Figure 5:
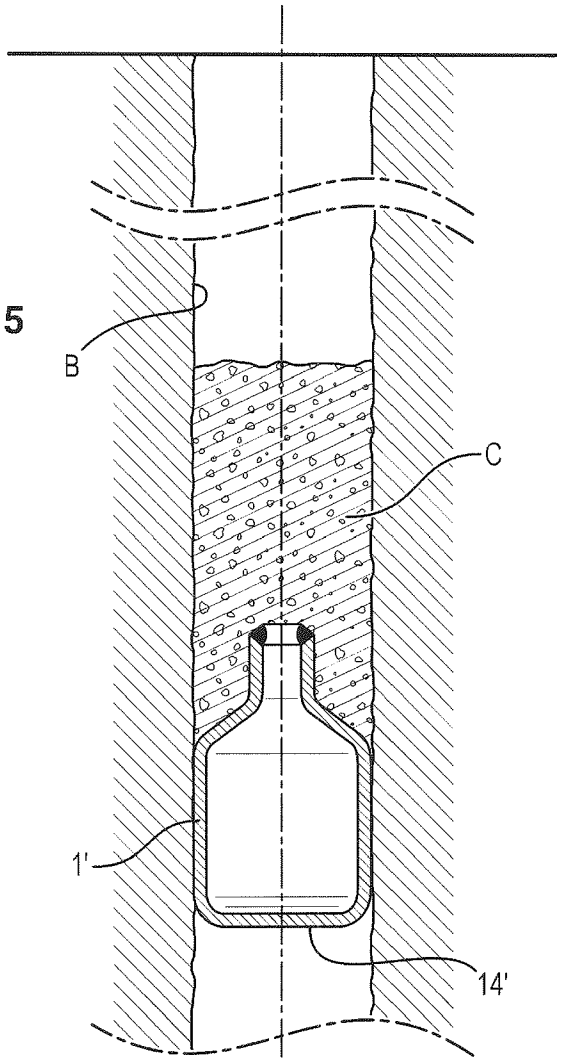

In reference to FIG. 5, it may be interesting in certain situations to consolidate this seal by means of a second barrier made up of a cement C that is injected over the plug.

It is a liquid cement, that is cured over time (at the end of a few hours or a few days in general), of the type currently used in the field of drilled wells.

Advantageously, to inject this cement, the same rod 2 is used as was used to position the plug; the liquid cement passes via channel 20.

The injection can be done immediately after the plug is crimped and the shaft disconnected, without having to remove it from the well.

It is understood that this operating procedure is faster and less expensive than when a separate cement device is used.

The constituent metal of the plug is obviously chosen sufficiently ductile to be able to be deformed without breaking beyond its elastic limit under the conditions of use, while being sufficiently resistant to the mechanical and physico-chemical stresses that it must undergo after positioning.

The width of its bottom and/or its bottleneck may be different, in particular larger, than that of its cylindrical body, since they do not need to be deformed to seal the well.

Advantageously, the metal in question is easily machined, so that it is possible to eventually drill plug 1' if necessary (as well as cement C, if applicable) in order to re-connect the parts of the well located above and below the plug.

Figure 6:
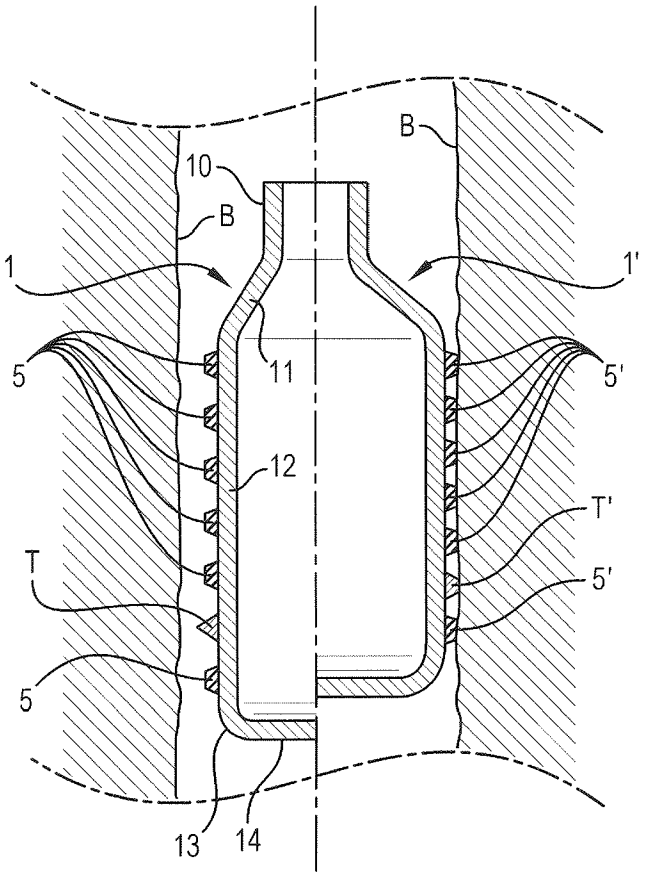
FIG. 6 shows a core plug provided with annular gaskets.

In reference to FIG. 6, plug wall 12 is coated on the outside with a collection of gaskets 5 of a flexible and incompressible (or only slightly compressible) elastomer material. In the example shown, these gaskets have a trapezoidal section and are glued at the periphery of wall 12.

When the plug is expanded (right part of the figure), these gaskets 5' are crushed and it is they that are supported against well wall B.

The presence of such gaskets is beneficial to accommodate surface irregularities of this wall, and also to compensate for the slight shrinkage (a reduction of diameter of around 0.1 mm in general) of wall 12 of the plug, a shrinkage that is unavoidable when the application of high pressure is stopped.

These gaskets can be O-rings housed in receiving grooves created in wall 12.

A mix of glued gaskets and O-rings is also possible.

A variant of embodiment is shown in the lower part of this FIG. 6.

In fact, note that metal pins T, preferably cone-shaped and attached to wall 12, extend between two gaskets. They extend circumferentially around the wall and are advantageously equidistant angularly from one another. They are attached to the wall, for example by welding.

A form of embodiment can be considered in which gaskets and "crowns" of pins alternate.

The lower right part of FIG. 6 shows that once the wall is deformed, pins T' penetrate at least partially into the material making up the well walls, which contributes to better anchorage of the plug.

Note that in the embodiment of the plug that has just been described, internal pressure P, which is implemented to induce the expansion of the plug, develops not only a radial component (desired) that allows expansion of annular part 12, but also an axial component (not desired) that acts downward on bottom wall 14.

This phenomenon, called "bottom effect" generates axial traction stresses in wall 12 in addition to circumferential traction stresses, which perceptibly limits the radial expansion capacity of the plug before breaking.

In practice, the amount of expansion measured on the plug diameter does not exceed around 10 to 20%.

Figure 8:
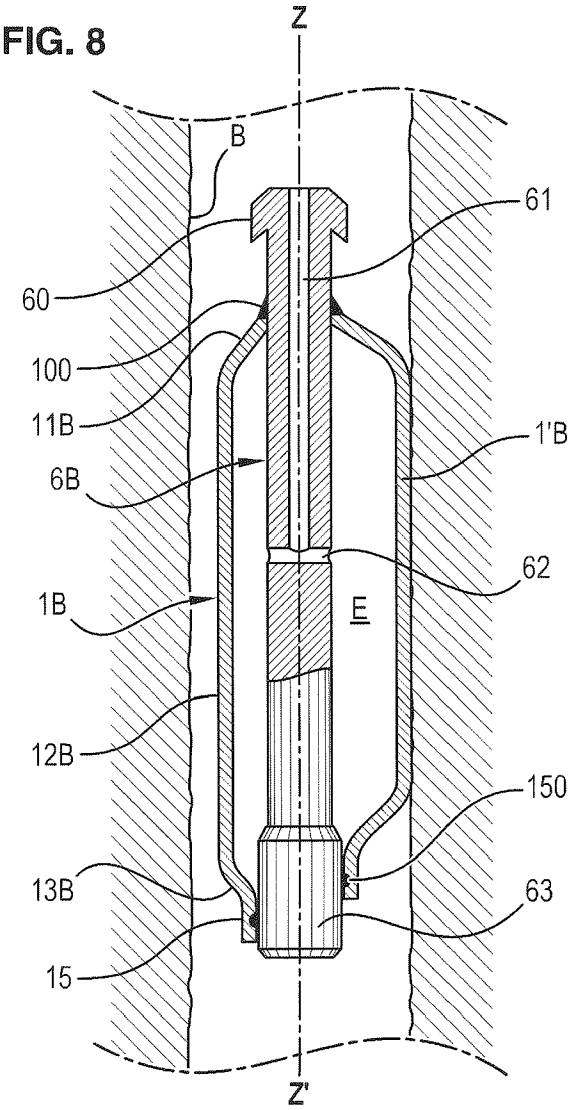
FIGS. 7 and 8 show two variants of the plug provided with a central mandrel, according to the invention.
Figure 7:
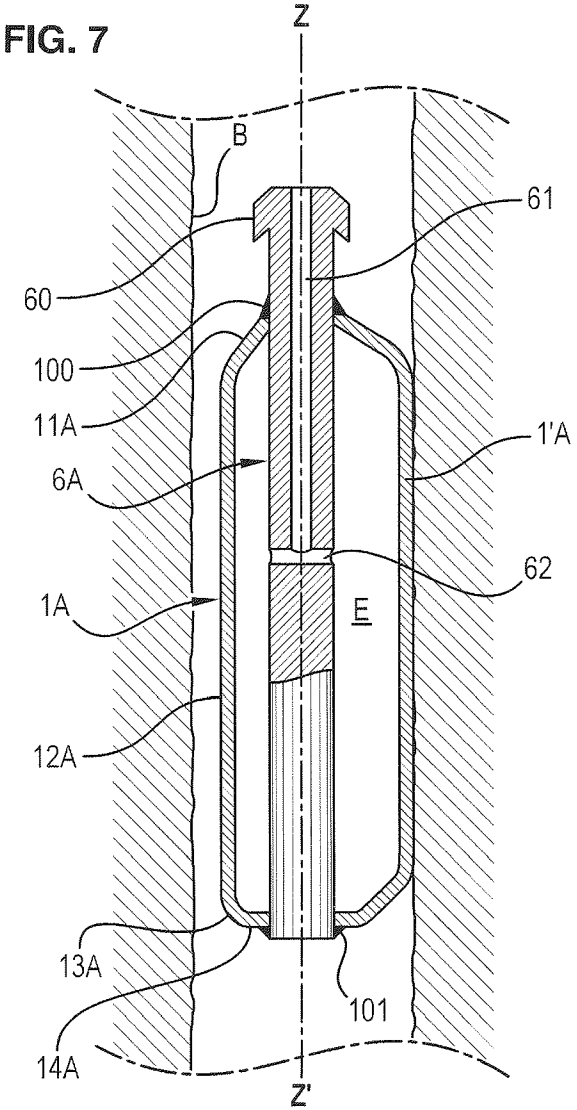

The embodiments according to the invention, illustrated in FIGS. 7 and 8 aim to reduce or even eliminate this bottom effect problem.

In FIG. 7, we see that plug 1A is provided with an inner cylindrical rod or mandrel, 6A, which crosses it axially from one side to the other. The upper part—or base—60 of the mandrel serves as the "bottleneck" for the mouth, by analogy with the embodiment of the plug, as a one-piece bottle, described previously.

References 11A, 12A, 13A, and 14A correspond respectively to references 11 to 14 of the embodiment of FIG. 1.

In the upper part, mandrel 6A is attached by an annular weld 100 to the mouth of upper part 11A of the wall.

At the lower part, mandrel 6A fits into a central opening formed in bottom 14A and is attached to the side of this opening by an annular weld 101.

A channel 61 pierced axially in the mandrel emerges via radial piercings 62 in inner space E of the plug, which allows introducing the HP liquid to inflate it.

In this embodiment, the mandrel—which serves as a spacer—absorbs the axial thrust developing on the plug wall, which limits the bottom effect, and allows obtaining a degree of expansion of around approximately 20 to 25%.

Reference 1'A in the right half view designates the plug after expansion.

In FIG. 8, we see that plug 1B is also provided with an inner cylindrical rod or mandrel 6B, which crosses it axially from one side to the other. Base 60 of the mandrel also serves here as the bottleneck of the plug.

References 11B, 12B, and 13B correspond, respectively, to references 11 to 13 of the preceding embodiment.

The plug bottom is embodied here by the lower part 63, in the form of a cylindrical bulge (of greater diameter) of mandrel 6B.

The lower end part of the plug 1B takes on the shape of a tubular sleeve 15 whose wall is provided on the inside with an annular gasket 150; this sleeve 15 is thus designed to slide axially and tightly on part 63 of the mandrel.

In the upper part, mandrel 6B is attached by an annular weld 100 to the mouth of upper part 11B of the wall of plug 1B.

A channel 61 pierced axially in this mandrel emerges via radial piercings 62 in inner space E of the plug, which allows introducing the HP liquid to inflate it.

In this embodiment, the radial expansion of the plug is not disrupted by axial stresses, taken up by the mandrel; its lower part can slide freely on mandrel bulge 63.

Radial expansion can therefore be done under optimal conditions, with natural axial shortening controlled by Poisson's coefficient, which allows obtaining a degree of expansion of around approximately 35 to 45%.

Reference 1'B in the right half view designates the plug after expansion.

It goes without saying that in the two embodiments of FIGS. 7 and 8, cylindrical parts 12A, respectively 12B, of the plugs are also advantageously provided with peripheral gaskets (as in FIG. 6).

In order to improve the hold of the plug inside the well after it is crimped, it may be useful to definitively maintain the internal pressure used to expand it.

This reduces the risk of eventual shrinkage and untimely loosening, and can facilitate eventual removal of the plug by fishing, if this proves necessary.

Figure 9:
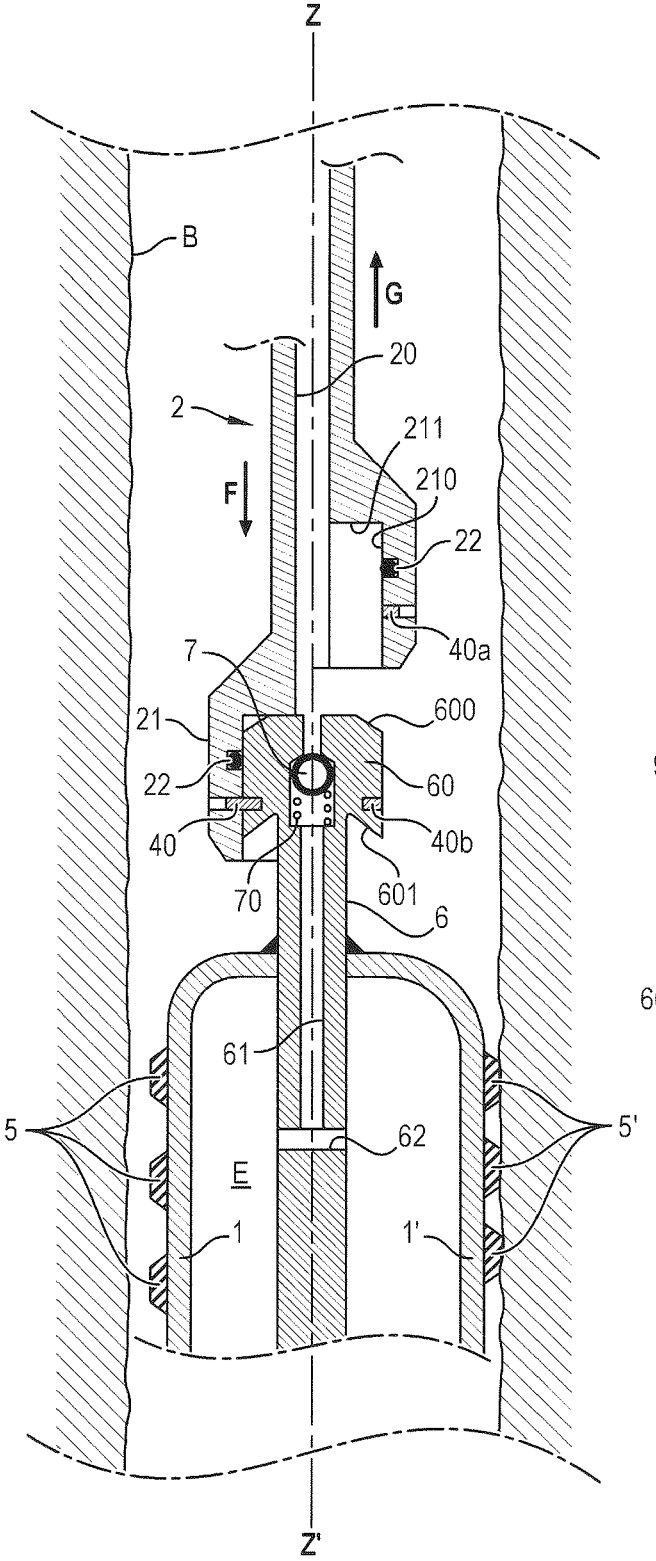
FIG. 9 shows the method applied to a plug provided with a check valve, which can keep it inflated after expansion.

To this end, as shown in FIG. 9, mandrel head 60 is provided with a check valve that here is simply an axially mobile ball 7, normally held in its seat by a spring 70. This valve holds the HP liquid trapped in inner space E of the plug, as long as this liquid pressure is greater than the external pressure.

As this liquid, it is possible to inject liquid cement at high pressure, which can be cured over time. In this case, wall 12A (or 12B) is in the unexpanded state closest to the mandrel, in order to prevent the sludge from being introduced into the plug.

The use of cement is particularly advantageous since this material, when it has hardened, increases the resistance of the plug over time to the pressure to which it is subjected.

The cylindrical wall of plug 1 is provided with a series of annular gaskets such as described in reference to FIG. 6.

Figure 10:
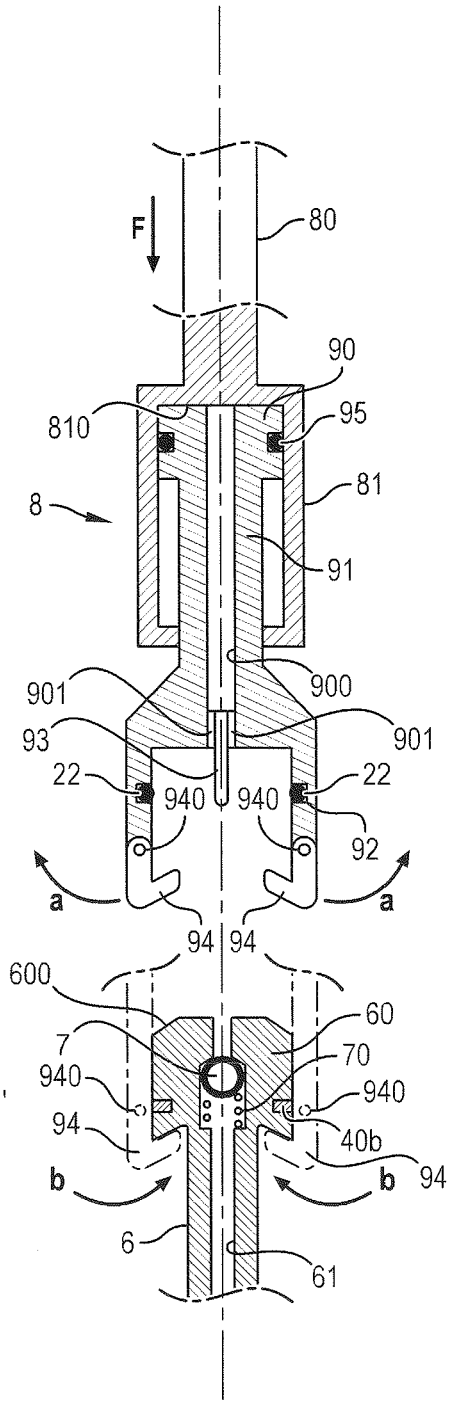
FIGS. 10 and 11 show the structure and illustrate the functioning of a "fishing" tool used to extract such a plug.

Base 60 of the mandrel has a particular shape designed to facilitate fishing out the plug by means of an extractor tool, designated 8 in FIG. 10.

This base is generally cylinder-shaped, with a beveled upper edge 600 and a tapered lower face 601 (downward concavity).

The device for positioning the plug comprises—as already explained in reference to FIGS. 1 to 4—a hollow cylindrical rod 2, pierced with a coaxial channel 20.

Here, its lower end has a widened part 21 in the form of a sleeve, open toward the bottom, and able to be axially fitted onto base 60. These two elements are joined to one another by breakable radial pins 40 (likely to break under a high shearing stress).

Moreover, cylindrical inner wall 210 of part 21 is provided with an O-ring 22 that is supported on the cylindrical wall of mandrel head 60.

The left part of FIG. 9 permits understanding how rod 2 and the plug are lowered conjointly into well B (Arrow F).

During this phase, flat bottom 211 of part 21 in the form of a sleeve rests against the upper face of base 60 as long as breakable pins 40 are not subjected to shearing.

When the desired depth is reached, an HP liquid is introduced into channel 20, which presses ball 7 back into its seat; the HP liquid penetrates into inner space E of the plug, inducing its radial expansion beyond the elastic limit of its wall, and correlatively, crimping it against the well wall (see right half view).

During this process, the presence of gasket 22 prevents HP liquid leaks between sleeve 21 and mandrel head 60.

After the operation, pressure in channel 20 is no longer applied, so that ball valve 7 naturally closes under the effect of spring 70, which serves to prevent the escape of HP liquid and to hold a very high overpressure inside the plug.

Removal of rod 2, by upward axial traction G breaks pins 40, of which one half 40*a* remains connected to the rod, and the other 40*b* to the mandrel.

Crimped sealing plug 1', with its compressed gaskets 5', then remains in place in the well while being subject to a high internal pressure, which guarantees an optimal hold.

Figure 11:
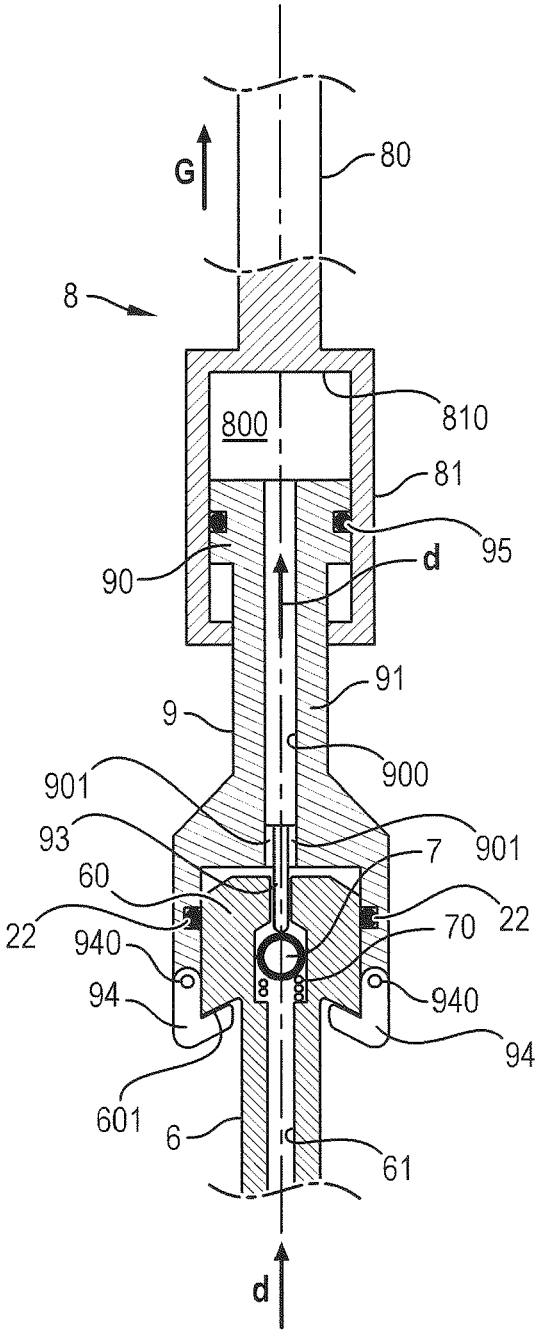

FIGS. 10 and 11 show how a sealing plug thus positioned can eventually be fished out if necessary, in which only the upper part of mandrel 6 is shown for clarity.

For this, a tool 8 is used comprising an axial rod 80 whose lower end bears a hollow cylindrical extension 81.

This tool also comprises an extractor component 9.

This component has a cylindrical rod 91 that bears, on the upper part, a widened cylindrical head 90, and on the lower part, a hollow part 92 in the shape of sleeve.

Lower part 92, like sleeve 21 described above, can be axially fixed onto head 60.

Head 90 is provided with an annular gasket 95 and is designed to slide axially in hollow extension 81, like a piston in the body of a hydraulic cylinder.

Extractor component 9 is pierced with a central axial channel 900. However, at its base, it has a small rod 93 (called pushrod), coaxial with channel 900, and which extends toward the bottom over a certain length inside hollow part 92 in the shape of a sleeve.

This small rod 93 is surrounded by several axial piercings 901 (for example four piercings distributed at) 90°) which connects channel 900 and the inside of sleeve 92.

At its base, sleeve 92 is provided with a set of hooks 94 in the form of fishhooks, for example four hooks distributed at 90°.

Each of these is articulated around a horizontal axis 904 so as to pivot toward the outside along a predetermined angular course, as shown by arrows a. However, each hook is pulled by an elastic return—spring or the like—(not shown) tending to pull it back toward the inside, in its rest position illustrated in FIG. 10.

These hooks are designed to hold mandrel head 60 by the bottom, resting against its lower tapered face 601.

In order to fish out the plug, first tool 8 is lowered (Arrow F), piston 90 normally resting against upper face 801 of the cavity of hollow extension 81.

When hooks 94 encounter bevel 600, they are forced to pivot toward the outside (arrow a) and thus to retract temporarily; then, when they are lowered beyond mandrel base 60, they pivot in the opposite direction by the effect of their return component (arrows b and dashed outline at the bottom of FIG. 10), and thus automatically hook base 601 of the mandrel head.

At the same time pushrod 93 has pushed back the ball of check valve 7, connecting channel 900 and channel 61, which itself communicates with inner space E of the inflated plug.

Then tool 8 is removed (Arrow G, FIG. 11).

First, hollow extension 81 only slides upward vertically with regard to head 90, because extractor 9 remains fixed, being held by its hooks gripping mandrel 6 (and therefore the plug).

After this relative movement, head 90 of the extractor is found progressively further from upper face 801 of the cavity of hollow extension 81, which induces a vacuum (suction) in space 800 thus formed, like a syringe plunger aspirating a liquid.

This vacuum is transmitted into the plug, aspirating the liquid found therein, which tends to deform the wall of the plug in the direction of a radial retraction toward the inside. At the end of course of head 90 in the cavity of hollow extension 81, the ascending movement of rod 80 is transmitted to extractor 9 so that hooks 94 positively pull mandrel 6 upward.

This traction, combined with the internal vacuum generated in the plug, allows the plug to be extracted relatively easily.

Several possible dimensional values are given below, simply by way of indication:

Axial length of the plug: Between 1 m and 2 m;

Diameter of the well: Between 15 cm and 50 cm;

Outer diameter of the plug: Between 12 cm and 45 cm;

Thickness of the plug wall (cylindrical part): Between 0.5 cm and 2.5 cm;

Pressure of the HP liquid used to inflate the plug: 400 bars, or $400\times10^5$ Pa.

The invention claimed is:

1. A method for sealing a well by means of a plug of ductile metal, which comprises a tubular wall part whose diameter is smaller than the diameter of the well, and a bottom wall part connected to the tubular wall part, said plug having an open end forming a mouth, the method comprising the steps of introducing the plug axially into said well, with the mouth of said plug turned up and the bottom wall part of said plug turned down, the plug being positioned in the well at a desired depth, after which the plug is inflated by injecting a high-pressure liquid into the plug via the plug's mouth so that the plug's tubular wall part expands radially beyond its elastic limit and comes to press firmly and tightly against the wall of the well by a crimping effect, while the bottom wall part of said plug serves as a sealing partition, forming a tight barrier between lower and upper parts of the well that it separates, the plug having an internal axial mandrel that connects the plug's open end forming the mouth to the plug's bottom wall, the mandrel being pierced with channels that allow injection of high-pressure liquid inside the plug via the mouth and the channels, wherein use is made of the plug, wherein the axial mandrel is attached to said plug wall at upper and lower ends of the wall, so that the mandrel constitutes a spacer that can impede shortening of the plug along the axial direction during the plug's radial expansion.

2. The method according to claim 1, wherein liquid curable cement is used as the high-pressure liquid.

3. The method according to claim 1, wherein said plug is introduced and positioned in the well by means of a hollow rod provided with an axial channel and is connected tightly to the mouth, the rod being maneuvered from a head of the well, and the high-pressure liquid being injected inside said plug from the head of the well via said pierced channel, to inflate and expand the plug.

4. The method according to claim 3, wherein after expanding and crimping the plug against the well wall, said hollow rod is disconnected from the crimped plug and is removed by axial traction.

5. The method according to claim 4, in which after expansion and crimping of the plug against the well wall, a liquid curable cement is poured, forming a second barrier, over the crimped plug, wherein the cement is poured into the well from a well head via the pierced channels of said hollow rod.

6. The method according to claim 1, wherein after expanding and crimping the plug against the well wall, a liquid curable cement is poured, forming a second barrier, over the crimped plug.

7. The method according to claim 1, wherein after positioning and inflating the plug, the high-pressure liquid is held inside the crimped plug.

8. The method of claim 1, wherein an upper part of the plug forming the mouth has a base further comprising extracting the plug crimped in the well with a tool, the tool comprising a handling rod with a lower end part that is provided with a set of articulated hooks that automatically grasp said base when the tool is axially lowered into the well, so that the crimped plug can then be extracted by upward axial traction.

9. The method according to claim 8, wherein the mouth of the plug is provided with a check valve designed to prevent the escape of high-pressure liquid from the plug after crimping, and wherein said lower end part of the tool is provided with a small axial pushrod that can open the check valve when the tool is lowered axially into the well, the lower end part coming to rest against said base, so that the high-pressure liquid can then escape the crimped plug.

10. The method according to claim 9, wherein the tool is provided with a suction piston and a cylinder designed to automatically generate a vacuum inside the crimped plus under the effect of axial traction exerted upwards on the rod.

11. A method of sealing a well with a metal core plug that comprises introducing the plug axially into the well, with a mouth of the plug turned up and a bottom wall part turned down, and positioning the plug in the well at a desired depth, after which the plug is inflated by injecting via the plug's mouth a high-pressure liquid so that a tubular wall part of the plug expands radially beyond its elastic limit and comes to press firmly and tightly against a wall of the well by a crimping effect, while the plug's bottom wall part serves as a sealing partition, forming a tight barrier between lower and upper parts of the well that it separates, the plug having the general shape of a bottle wherein the mouth corresponds to a neck of said bottle, wherein said plug has an axial mandrel inside that connects the plug's mouth to the plug's bottom wall, the mandrel being pierced with channels that allow injection of high-pressure liquid inside the plug via the mouth and the channels, and wherein the axial mandrel is attached to the plug wall at upper and lower ends of the wall so that the mandrel constitutes a spacer that can impede shortening of the plug along the axial direction during the plug's radial expansion.

12. The method according to claim 11, wherein said tubular wall part is provided externally with at least one annular gasket of flexible and elastic material, that can be crushed to press intimately against the well wall after crimping, and/or with metal pins that can at least partially penetrate into the well wall.

13. The method according to claim 11, wherein an upper part of the plug forming the mouth has a base with a hooking profile that allows extracting the crimped plug by means of a tool provided with suitable hooks.

14. The method according to claim 13, further comprising a tool for extracting the core plug, the tool comprising a handling rod with a lower end part that is provided with a set of articulated hooks that automatically grasp said base when the tool is axially lowered into the well, so that the crimped plug can then be extracted by upward axial traction.

15. The method according to claim 14, wherein the mouth of the plug is provided with a check valve designed to prevent the escape of high-pressure liquid from the plug after crimping, and wherein said lower end part of the tool is provided with a small axial pushrod that can open the check valve when the tool is lowered axially into the well, the lower end part coming to rest against said base, so that the high-pressure liquid can then escape the crimped plug.

16. The method according to claim 15, wherein the tool is provided with a suction piston and a cylinder designed to automatically generate a vacuum inside the crimped plug under the effect of axial traction exerted upwards on the rod.

17. The method according to claim 11, in which an upper part of the plug forming the mouth has a base with a hooking profile that allows extracting the crimped plug by means of a tool provided with suitable hooks, the base with said hooking profile being made up of an upper part of the mandrel.

18. The method according claim 11, wherein a wall of the plug is made of stainless steel.

* * * * *